US006497501B1

(12) United States Patent
Harder

(10) Patent No.: US 6,497,501 B1
(45) Date of Patent: Dec. 24, 2002

(54) GLARE REDUCING VISOR FOR EXISTING PAR BULB EXTERIOR LIGHTING FIXTURES

(76) Inventor: Susan Harder, 26 Deep Six Dr., East Hampton, NY (US) 11937

( * ) Notice: Subject to any disclaimer, the term of this patent is extended or adjusted under 35 U.S.C. 154(b) by 0 days.

(21) Appl. No.: 10/002,538

(22) Filed: Nov. 1, 2001

(51) Int. Cl.[7] ..... F21V 17/04
(52) U.S. Cl. ..... 362/359
(58) Field of Search ..... 362/359, 352, 362/361, 377

(56) References Cited

U.S. PATENT DOCUMENTS 1,479,879 A * 1/1924 Steinhilper ..... 362/359
1,600,682 A * 9/1926 McCarley ..... 362/359
4,519,018 A * 5/1985 Rowland ..... 362/359
4,866,582 A * 9/1989 Osteen et al. ..... 362/359
5,211,473 A * 5/1993 Gordin et al. ..... 362/359
5,313,379 A * 5/1994 Lemons et al. ..... 362/359
5,584,574 A * 12/1996 Haddad ..... 362/359
5,651,606 A * 7/1997 Krogman ..... 362/359

OTHER PUBLICATIONS

Nova Industries, Inc. Honeylite Product Catalog 2000.

* cited by examiner

*Primary Examiner*—Laura K. Tso
(74) *Attorney, Agent, or Firm*—Thomas A. Gallagher

(57) ABSTRACT

A PAR bulb visor includes an accessory visor with a plurality of spaced apart spring clips which is adapted to removably attach to the lip of a PAR bulb. The visor is retrofittable to virtually any existing PAR bulb fixture where the lip of the bulb is exposed. The visor is inexpensive to manufacture. It does not require casting and can be made from inexpensive sheet metal. Since the visor can be easily installed and removed from the lip of an existing PAR bulb, it does not interfere with the installation/replacement of the bulb.

18 Claims, 3 Drawing Sheets

GLARE REDUCING VISOR FOR EXISTING PAR BULB EXTERIOR LIGHTING FIXTURES

BACKGROUND OF THE INVENTION

1. Field of the Invention

The invention relates to exterior lighting fixtures. More particularly, the invention relates to a visor which is retrofittable to an existing PAR bulb to thereby reduce glare, increase lighting efficiency, control light output, and minimize light trespass and light pollution.

2. State of the Art

For many years astronomers complained that the night-time light from large cities interfered with their ability to detect far off faint stars. It is for this reason that most astronomical observatories are located far away from densely populated cities.

More recently, other groups have concerned themselves with the adverse effects of uncontrolled exterior lighting. These groups include the New England Light Pollution Advisory Group (NELPAG), the International Dark-Sky Association (IDA), the Illuminating Engineering Society of North America (IESNA), the Commission Internationale de l'Eclairage (CIE), the Electric Power Research Institute (EPRI), and the UK Institution of Lighting Engineers, (ILE).

The adverse effects of uncontrolled exterior lighting include "light trespass", light that strays from its intended purpose and becomes an annoyance or nuisance, and "light pollution", night-sky brightness (sky glow) caused by light illuminating particulate matter in the atmosphere. The sources of light pollution and light trespass typically include light projected above a horizontal plane or light reflected from illuminated surfaces such as roadways.

An increasing number of states and municipalities have been involved in the alteration of the use of exterior lighting by instituting laws and ordinances. One solution has been the establishment of a "lighting curfew", an established time frame within which lighting must be maintained according to predetermined levels. Other solutions include restrictions on the type of exterior lighting fixtures which may be used.

One of the most common exterior lighting fixtures is the simple PAR bulb flood (or spot) light 10 which is illustrated in prior art FIG. 1. The fixture 10 includes a mounting plate 12, a weather resistant bulb socket 14 and a replaceable PAR bulb 16. The familiar PAR bulb 16 has a frustroconical portion terminating in a lip 18. These fixtures 10 may not pose a serious problem if the axis of the bulb is aimed thirty or forty degrees below horizontal. They are almost always a problem when aimed above horizontal as shown in FIG. 1. These fixtures are often used to illuminate signs, buildings, monuments, and the like and are either aimed up from the ground as illustrated, or mounted on the side of a building. When so used, these ubiquitous fixtures contribute substantially to light trespass and light pollution.

Prior art FIGS. 2–4 illustrate products available from RAB Electric Manufacturing, Inc., 170 Ludlow Avenue, Northvale, N.J. 07647. These fixtures are often referred to as "dark sky" or "friendly" lighting fixtures. The fixtures 20 and 30 shown in prior art FIGS. 2 and 3, respectively, include a die cast aluminum housing 22, 32, respectively, which covers the sides of a standard PAR bulb 16 and extends approximately one inch beyond the bulb to provide a shade to reduce glare. An optional visor 40 shown in prior art FIG. 4 is provided with an engaging end 42 so that it securely mates with either fixture 20 or 30.

The fixtures shown in prior art FIGS. 2–4 are highly effective in controlling light pollution and light trespass. However, they have three significant disadvantages. First, they are expensive compared to the common fixtures shown in prior art FIG. 1. Second, in order to obtain their benefits, existing fixtures must be replaced, which includes re-wiring by a licensed electrician. Third, unless they are properly dimensioned, it is difficult to install and remove bulbs in these fixtures. Those skilled in the art will appreciate that the space between the circumference of the bulb 16 and the hood 22, 32 is often too small to allow thumb and fingers to grip the bulb during installation/removal. Thus, a special tool is often required for this purpose.

SUMMARY OF THE INVENTION

It is therefore an object of the invention to provide a dark sky/friendly lighting fixture which overcomes the disadvantages of the prior art.

It is also an object of the invention to provide a dark sky/friendly lighting fixture which is relatively inexpensive.

It is another object of the invention to provide a dark sky/friendly lighting fixture which does not require the replacement of existing fixtures.

It is still another object of the invention to provide a dark sky/friendly lighting fixture which does not inhibit the installation or removal of bulbs.

In accord with these objects which will be discussed in detail below, the PAR bulb visor of the present invention includes an accessory visor with a plurality of spaced apart spring clips which is adapted to removably attach to the lip of a PAR bulb. The visor of the present invention is retrofittable to virtually any existing PAR bulb fixture where the lip of the bulb is exposed. The visor of the invention is inexpensive to manufacture. It does not require casting and can be made from inexpensive sheet metal. Since the visor of the invention can be easily installed and removed from the lip of an existing PAR bulb, it does not interfere with the installation/replacement of the bulb.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
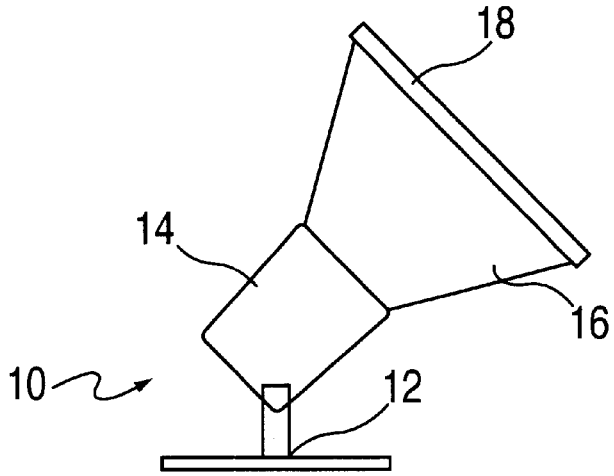
FIG. 1 (PRIOR ART)
FIG. 1 is a side elevation view of a prior art PAR bulb fixture.
Figure 2:
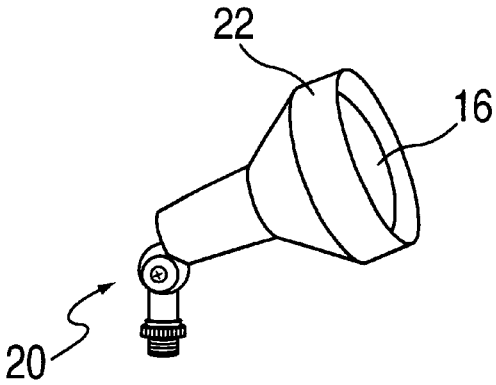
FIG. 2 (PRIOR ART)
FIGS. 2 and 3 are perspective views of prior art PAR bulb fixtures having integral hoods.
Figure 3:
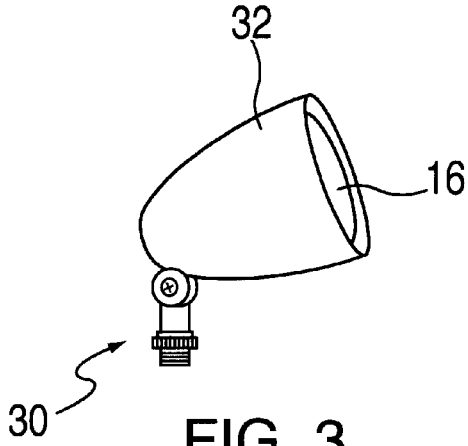
FIG. 3 (PRIOR ART)
Figure 4:
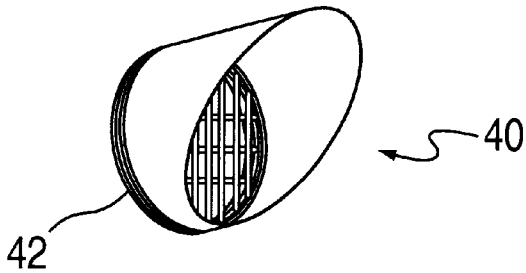
FIG. 4 (PRIOR ART)
FIG. 4 is a perspective view of a prior art visor specially designed to fit onto the hoods of the fixtures in FIGS. 2 and 3.
Figure 5:
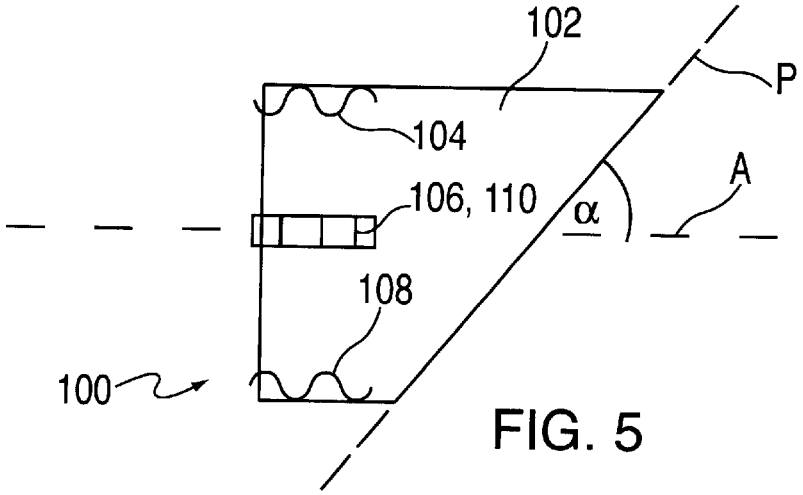
FIG. 5 is a transparent side elevation view of a first embodiment of the invention.

Referring now to FIGS. 1 and 2, a first embodiment 100 of the invention includes a cylindrical visor 102 with a plurality of spring clips 104, 106, 108, 110 mounted on an interior surface 112 of the visor 102. The visor 102 is preferably a truncated cylinder, i.e. a cylinder transected by a plane P through the longitudinal axis A of the cylinder at an angle α. The angle α is preferably between thirty and forty-five degrees. As seen best in FIG. 5, the spring clips 104, 106, 108, 110 are mounted adjacent the non-truncated end of the cylinder.

Figure 6:
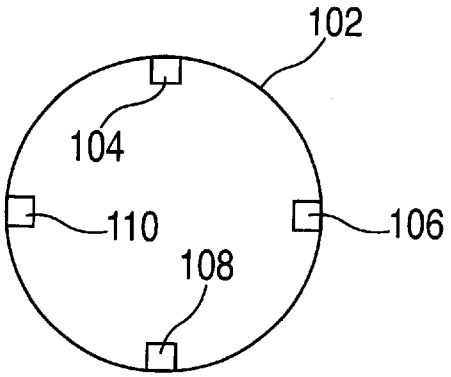
FIG. 6 is an end view of the embodiment of FIG. 5.
Figure 7:
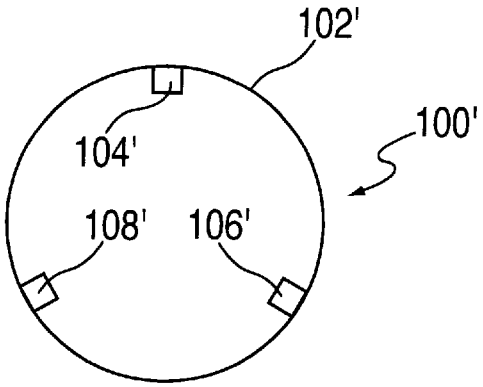
FIG. 7 is an end view of a second embodiment of the invention.

According to the first embodiment of the invention, as seen best in FIG. 6, the spring clips 104, 106, 108, 110 number four and are evenly spaced at approximately ninety degrees relative to each other. According to a second embodiment 100' of the invention, shown in FIG. 7, the spring clips number 104', 106', 108' number three and are mounted on the interior surface of the visor 102' at equally spaced intervals of approximately one hundred twenty degrees.

Figure 8:
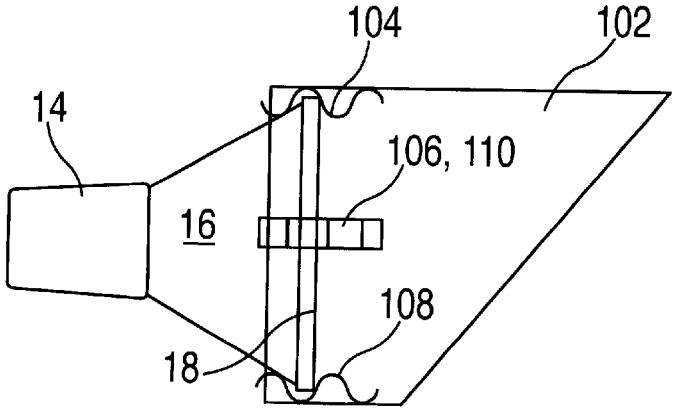
FIG. 8 is a transparent side elevation view of the first embodiment of the invention coupled to a PAR bulb.

Referring now to FIG. 8, it can be seen how the visor 102 (102')of the invention is easily retrofitted to an existing PAR bulb 16 in an existing inexpensive fixture socket 14. As shown in FIG. 8 and as will be appreciated by those skilled in the art in view of the foregoing disclosure, the diameter of the visor 102 is preferably such that it fits comfortably over the PAR bulb 16 such as illustrated in FIG. 8. The diameter is therefore approximately five an one half inches. According to a presently preferred embodiment, the overall length of the visor is approximately five and one quarter inches. However, it will be appreciated that, depending on the application, the length of the visor may longer. It will also be appreciated that the configuration of the spring clips will depend to some extent on the diameter of the visor. According to the presently preferred embodiment, the spring clips are approximately three eighths of an inch wide and are substantially sinusoidal so that they can slip over the lip 18 of the bulb 16 and still grip the bulb securely.

Figure 9:
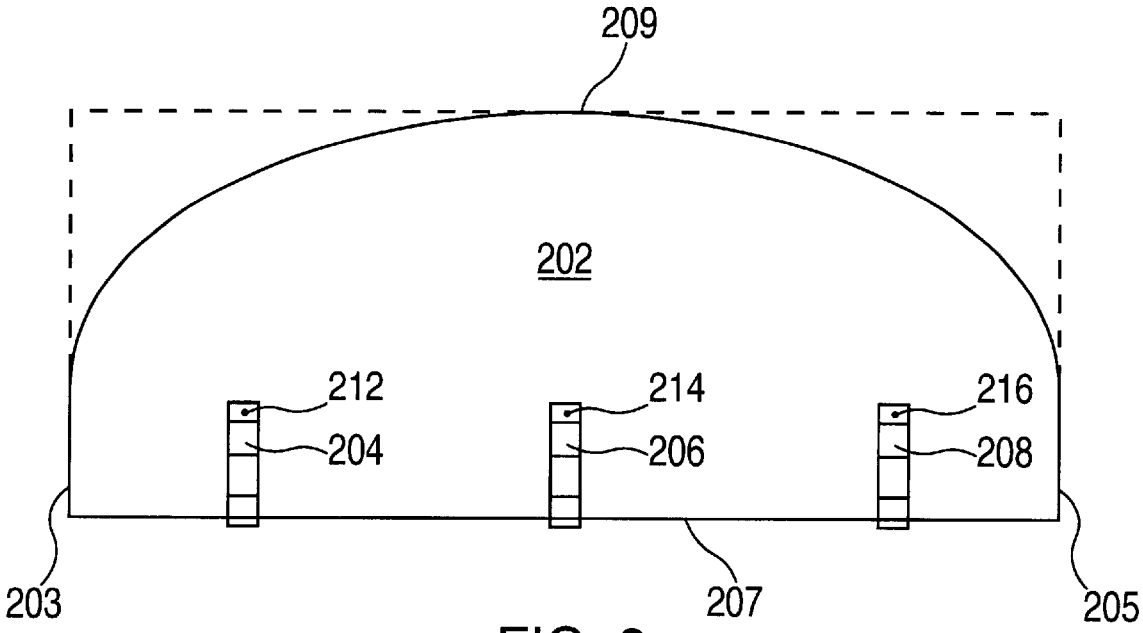
FIG. 9 is a plan view illustrating how the visor of the invention is inexpensively fabricated from sheet metal.

Turning now to FIG. 9, a presently preferred visor 202 according to the invention is made from a rectangular sheet of aluminum sheet metal. As shown in FIG. 9, the sheet has two minor sides 203, 205 which are, prior to cutting, approximately five and one quarter inches long, and two major sides 207, 209 which are, prior to cutting, approximately a little more than sixteen inches long.

As illustrated by the phantom lines in FIG. 9, portions of the rectangular sheet are removed so that the side 209 assumes a curvature. As shown in FIG. 9, spring clips 204, 206, and 208 are coupled to the sheet 202 with rivets 212, 214, 216, respectively. It will be appreciated that other suitable fastening means may be employed. According to the presently preferred embodiment, the sheet 202 is rolled into cylindrical form (either before or after the spring clips are attached, and the ends 203, 205 are coupled to each other with welds. It will be understood that fastening means other than welds could be used.

According to other aspects of the invention, the exterior surface of the visor of the invention may be coated with a non-reflective finish in a suitable color such as bronze, black, white, or green. The interior surface may be wither non-reflective or reflective depending on the application.

There have been described and illustrated herein several embodiments of a PAR bulb visor. While particular embodiments of the invention have been described, it is not intended that the invention be limited thereto, as it is intended that the invention be as broad in scope as the art will allow and that the specification be read likewise. Thus, while the preferred embodiment is circular cylindrical, it will be appreciated that other polygonal cylinders which approximate circular cylinders could be used. Also, while three or four spring clips have been shown, it will be recognized that more could be used with similar results obtained. Moreover, while particular configurations have been disclosed in reference to sheet metal, it will be appreciated that the visor (including the spring clips) could be made of other materials provided that the materials are suitable for use in close proximity to a PAR bulb. Thus, if the visor were to be made out of a plastic material, it must be able to resist deformation under the heat generated by the PAR bulb. In addition, while the visor has been described and illustrated as a continuous cylindrical member, an effective visor could be made from a discontinuous cylinder, provided the material used had sufficient rigidity. For example, a discontinuous cylinder of less than three hundred sixty degrees, but no less than one hundred eighty degrees could be effective. It will therefore be appreciated by those skilled in the art that yet other modifications could be made to the provided invention without deviating from its spirit and scope as so claimed.

What is claimed is :

1. A visor for a PAR bulb, said visor comprising:

a) a substantially cylindrical member having a first end and a second end; and b) a plurality of spring clips coupled to said first end, wherein said substantially cylindrical member has a diameter larger than that of a PAR bulb and said spring clips are dimensioned and arranged to grip a PAR bulb snugly when said first end of said substantially cylindrical member is slipped over a PAR bulb.

2. A visor according to claim 1, wherein:

said substantially cylindrical member has a longitudinal axis and said second end is truncated by a plane passing through said longitudinal axis at an angle α.

3. A visor according to claim 2, wherein:

said angle α is an angle between approximately thirty and forty-five degrees.

4. A visor according to claim 1, wherein:

said plurality of spring clips consists of three spring clips spaced at approximately one hundred twenty degrees from each other.

5. A visor according to claim 1, wherein:

said plurality of spring clips consists of four spring clips spaced at approximately ninety degrees from each other.

6. A visor according to claim 1, wherein:

said spring clips have a substantially sinusoidal configuration.

7. A visor according to claim 1, wherein:

said substantially cylindrical member is made from a sheet material.

8. A visor according to claim 1, wherein:

said spring clips are coupled to said substantially cylindrical member by rivets.

9. A visor according to claim 1, wherein:

said substantially cylindrical member has an exterior surface which is non-reflective.

10. A visor for a PAR bulb, said visor comprising:

a) a shade member having a first end and a second end, said shade member being at least one half of a substantially cylindrical member; and b) a plurality of spring clips coupled to said first end, wherein said shade member is dimensioned to fit over a PAR bulb and said spring clips are dimensioned and arranged to grip a PAR bulb snugly when said first end of said shade member is slipped over a PAR bulb.

11. A visor according to claim 10, wherein:

said shade member has a longitudinal axis and said second end is truncated by a plane passing through said longitudinal axis at an angle $\alpha$.

12. A visor according to claim 11, wherein:

said angle $\alpha$ is an angle between approximately thirty and forty-five degrees.

13. A visor according to claim 10, wherein:

said plurality of spring clips consists of three spring clips.

14. A visor according to claim 10, wherein:

said plurality of spring clips consists of four spring clips.

15. A visor according to claim 10, wherein:

said spring clips have a substantially sinusoidal configuration.

16. A visor according to claim 10, wherein:

said shade member is made from a sheet material.

17. A visor according to claim 10, wherein:

said spring clips are coupled to said shade member by rivets.

18. A visor according to claim 10, wherein:

said shade member has an exterior surface which is non-reflective.

* * * * *